US008480413B2

(12) United States Patent
Minich et al.

(10) Patent No.: US 8,480,413 B2
(45) Date of Patent: Jul. 9, 2013

(54) ELECTRICAL CONNECTOR HAVING COMMONED GROUND SHIELDS

(75) Inventors: Steven E. Minich, York, PA (US); Mark R. Gray, York, PA (US); Vittal Balasubramanian, Camp Hill, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/246,017

(22) Filed: Sep. 27, 2011

(65) Prior Publication Data

US 2012/0077380 A1 Mar. 29, 2012

Related U.S. Application Data

(60) Provisional application No. 61/386,613, filed on Sep. 27, 2010.

(51) Int. Cl.
*H01R 4/66* (2006.01)

(52) U.S. Cl.
USPC ..... 439/95; 439/607.05

(58) Field of Classification Search
USPC ..... 439/92, 95, 108, 607.05–607.11
See application file for complete search history.

(56) References Cited

U.S. PATENT DOCUMENTS

| | | | |
|---|---|---|---|
| 5,174,770 | A | 12/1992 | Sasaki et al. |
| 5,474,472 | A | 12/1995 | Niwa et al. |
| 5,904,594 | A | 5/1999 | Longueville et al. |
| 6,053,751 | A | 4/2000 | Humphrey |
| 6,146,202 | A | 11/2000 | Ramey et al. |
| 6,220,896 | B1 | 4/2001 | Bertoncini et al. |
| 6,743,057 | B2 | 6/2004 | Davis et al. |
| 7,074,086 | B2 | 7/2006 | Cohen et al. |
| 7,789,716 | B2 | 9/2010 | Fedder et al. |
| 8,137,119 | B2 | 3/2012 | Stoner |
| 2003/0181077 | A1 | 9/2003 | Rothermel et al. |
| 2006/0003628 | A1 | 1/2006 | Long et al. |
| 2006/0189212 | A1 | 8/2006 | Avery et al. |
| 2007/0042639 | A1 | 2/2007 | Manter et al. |

FOREIGN PATENT DOCUMENTS

| | | |
|---|---|---|
| WO | WO 2009/111283 | 9/2009 |
| WO | WO 2010/068671 | 6/2010 |

*Primary Examiner* — Khiem Nguyen
(74) *Attorney, Agent, or Firm* — Woodcock Washburn LLP

(57) ABSTRACT

A row-based electrical connector includes a connector housing that supports a plurality of electrical contacts that define broadside coupled differential signal pairs along a row direction. The electrical connector further includes conductive ground shields disposed between adjacent differential signal pairs, and a conductive plate in electrical communication with the ground shields and electrically isolated from the differential signal pairs.

28 Claims, 8 Drawing Sheets

ELECTRICAL CONNECTOR HAVING COMMONED GROUND SHIELDS

CROSS-REFERENCE TO RELATED APPLICATIONS

This claims the benefit of U.S. Patent Application Ser. No. 61/386,613 filed Sep. 27, 2010, the disclosure of which is hereby incorporated by reference as if set forth in its entirety herein.

TECHNICAL FIELD

The present disclosure relates generally to the field of electrical connectors, and in particular relates to an electrical connector that is configured to improve signal integrity at high data transfer speeds.

BACKGROUND

Electrical connectors provide signal connections between electronic devices using electrically-conductive contacts, or electrical contacts. In some applications, an electrical connector provides a connectable interface between one or more substrates, e.g., printed circuit boards. One example electrical connector assembly can include a first electrical connector, such as a receptacle connector, that can be mounted to a first substrate, and a complementary second electrical connector, such as a header connector, that can be mounted to a second substrate. Typically, a plurality of electrical contacts of the receptacle connector is adapted to mate with a corresponding plurality of electrical contacts of the header connector. For instance, the electrical contacts of the receptacle connector can receive the electrical contacts of the header connector or otherwise mate with the electrical contacts of the header connector so as to establish an electrical connection between the electrical contacts of the receptacle connector and the electrical contacts of the header connector.

The electrical contacts of both the header and receptacle connectors typically include a respective plurality of signal contacts and a respective plurality of ground contacts. Often, the signal contacts are so closely spaced that undesirable interference, or "cross talk," occurs between adjacent signal contacts. As used herein, the term "adjacent" refers to contacts (or rows or columns) that are next to one another. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

SUMMARY

In accordance with one embodiment, an electrical connector includes a connector housing that defines a mating interface and a mounting interface, the connector housing supporting a plurality of electrical contacts that define a plurality of broadside coupled differential signal pairs. The electrical contacts of the differential signal pairs are spaced along a row direction. The electrical connector further includes a plurality conductive ground shields disposed between adjacent differential signal pairs along the row direction. The electrical connector further includes a conductive ground commoning member in electrical communication with the ground shields and electrically isolated from the differential signal pairs.

BRIEF DESCRIPTION OF THE DRAWINGS

The foregoing summary, as well as the following detailed description of example embodiments of the present disclosure, will be better understood when read in conjunction with the appended drawings. For the purposes of illustrating the example embodiments of the present disclosure, references to the drawings are made. It should be understood, however, that the application is not limited to the precise arrangements and instrumentalities shown. In the drawings.

DETAILED DESCRIPTION

Figure 1A:
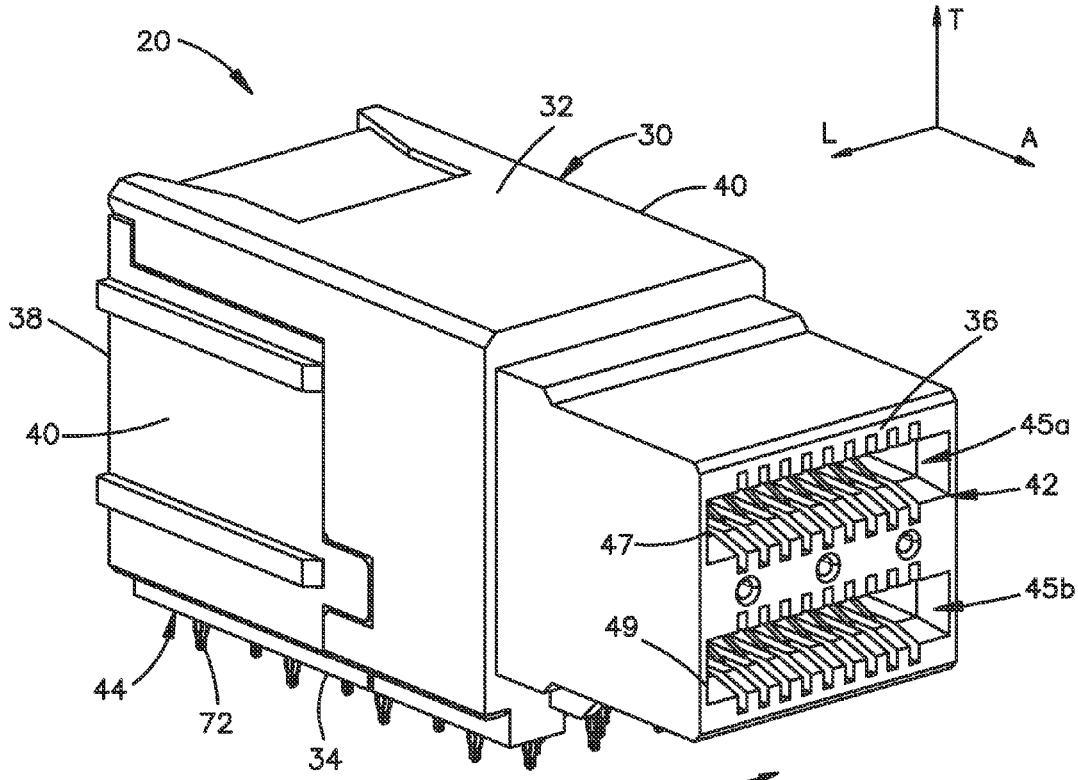
FIG. 1A is a perspective view of an electrical connector constructed in accordance with one embodiment.
Figure 1B:
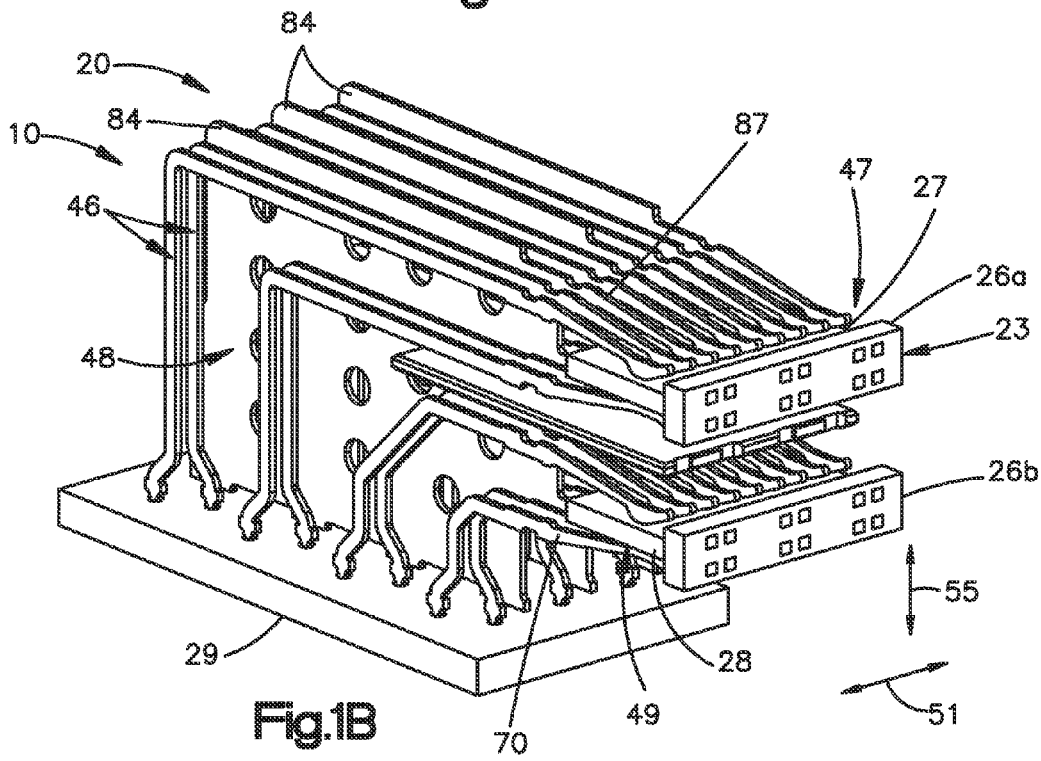
FIG. 1B is a perspective view of the electrical connector illustrated in FIG. 1A, shown with the housing removed, mounted to a substrate and mated to a pair of complementary electrical components.
Figure 2A:
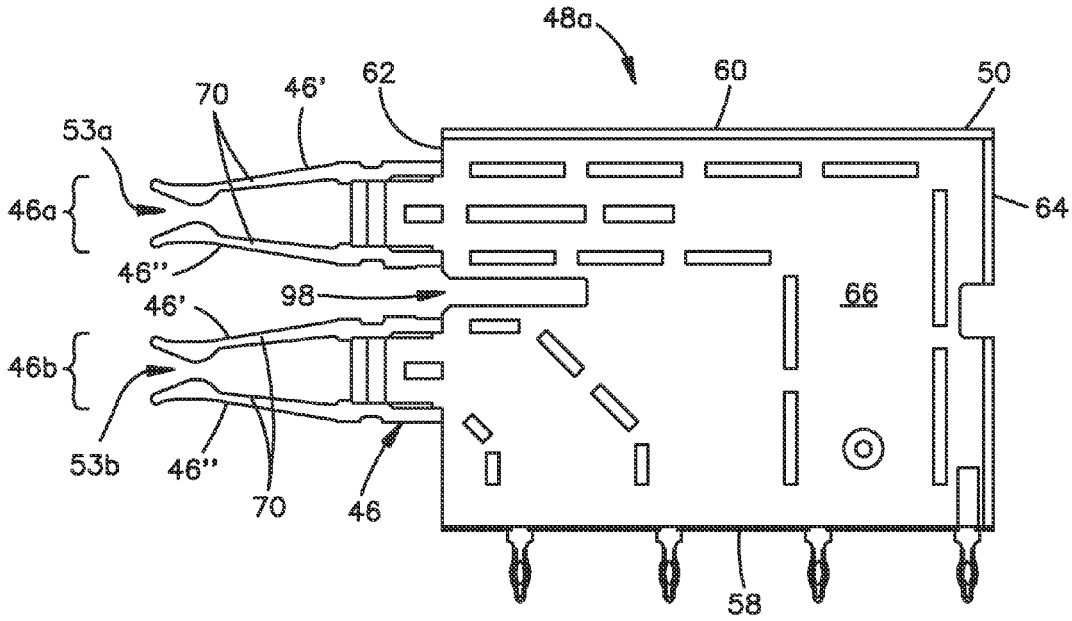
FIG. 2A is a side elevation view of a first leadframe assembly of a first plurality of leadframe assemblies of the electrical connector illustrated in FIG. 1A, wherein the first leadframe assembly includes a first leadframe housing and a first plurality of electrical contacts supported by the first leadframe housing.
Figure 2B:
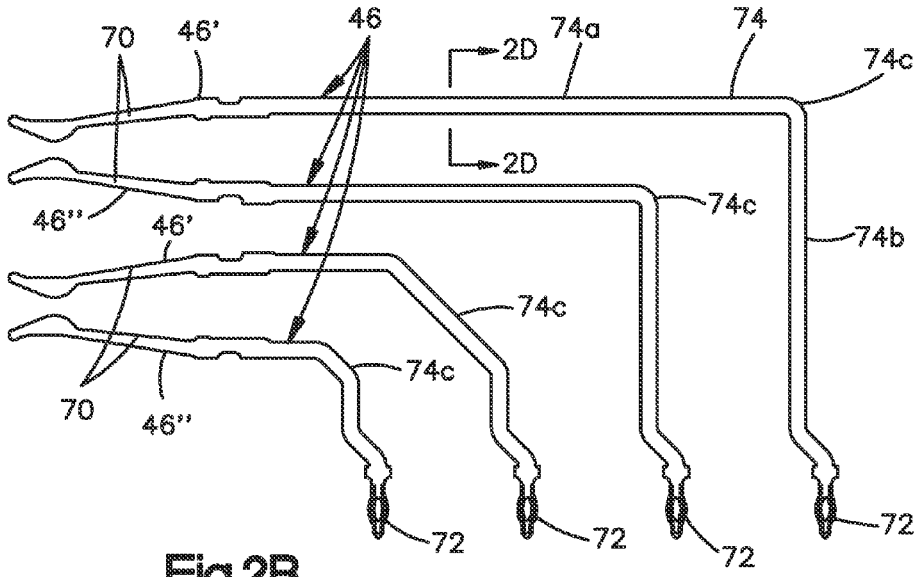
FIG. 2B is a side elevation view of the first plurality of electrical contacts of the first leadframe assembly illustrated in FIG. 2A.
Figure 2C:
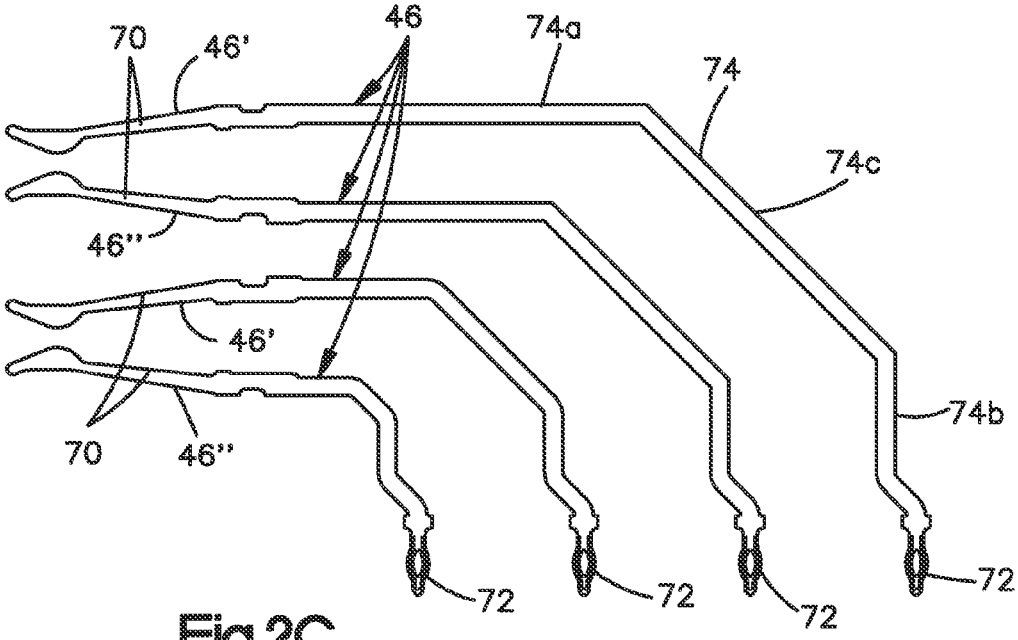
FIG. 2C is a side elevation view of the first plurality of electrical contacts as illustrated in FIG. 2B, but constructed in accordance with an alternative embodiment.
Figure 2D:
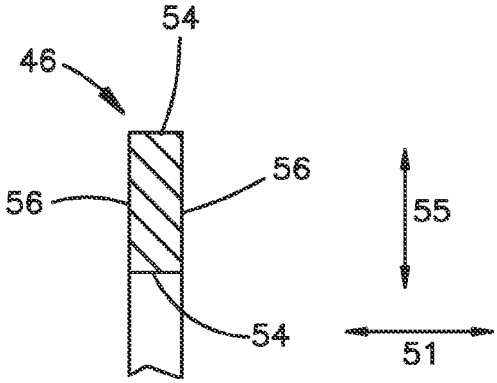
FIG. 2D is a sectional end elevation view of the first plurality of electrical contacts of FIG. 3B as represented by one of the first plurality of electrical contacts taken along line 2D-2D.
Figure 3A:
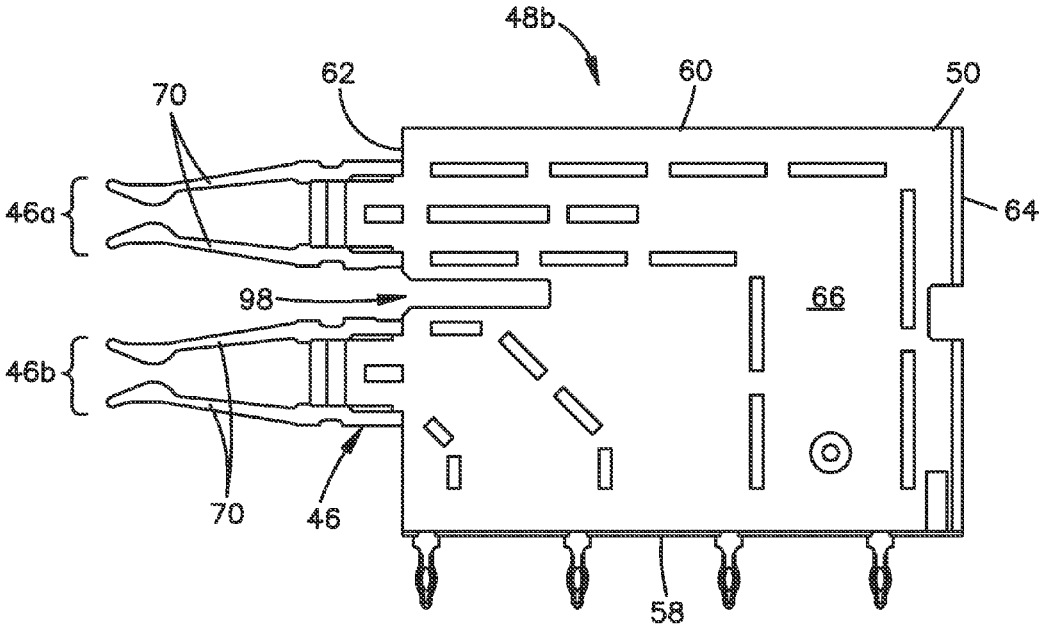
FIG. 3A is a side elevation view of a second leadframe assembly of a second plurality of leadframe assemblies of the electrical connector illustrated in FIG. 1A, wherein the second leadframe assembly includes a second leadframe housing and a second plurality of electrical contacts supported by the second leadframe housing.
Figure 3B:
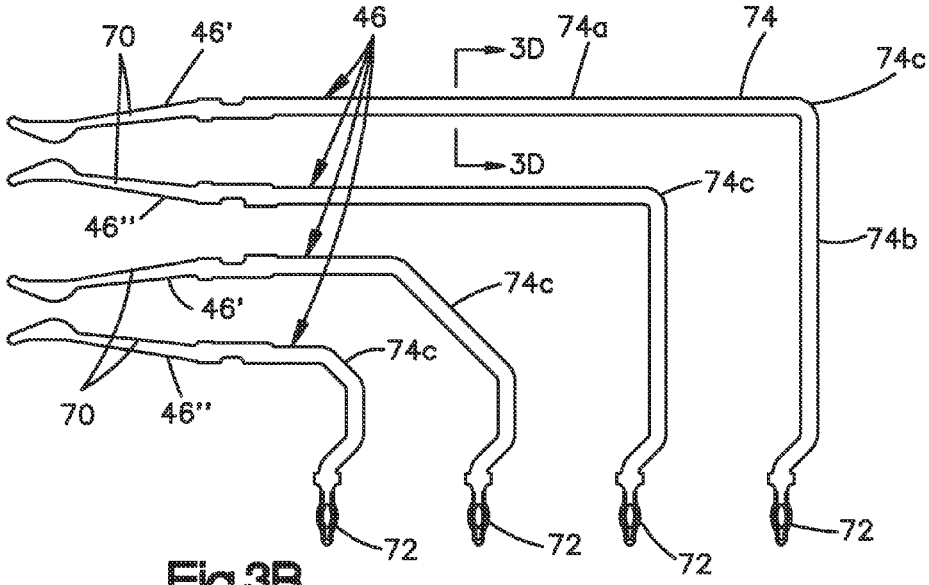
FIG. 3B is a side elevation view of the second plurality of electrical contacts of the second leadframe assembly illustrated in FIG. 3A.
Figure 3C:
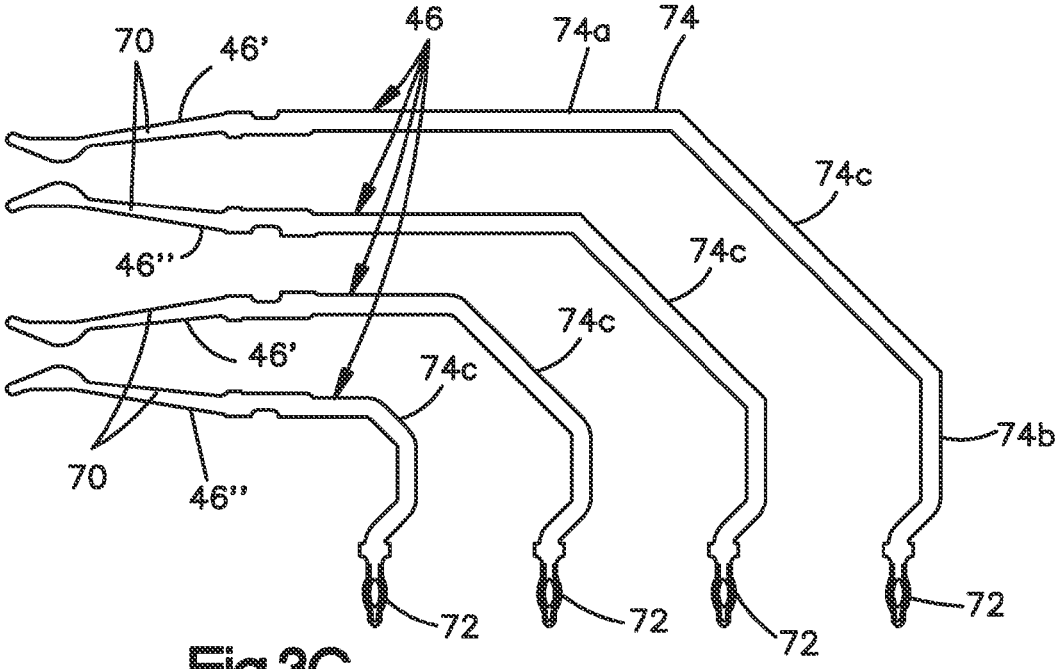
FIG. 3C is a side elevation view of the first plurality of electrical contacts as illustrated in FIG. 3B, but constructed in accordance with an alternative embodiment.
Figure 3D:
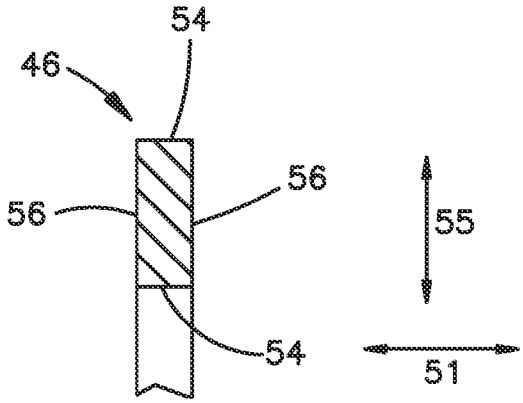
FIG. 3D is a sectional end elevation view of the second plurality of electrical contacts of FIG. 3B as represented by one of the second plurality of electrical contacts taken along line 3D-3D.

Referring to FIGS. 1A-B, an electrical connector system 10 includes an electrical connector 20 and a complementary electrical component 23, which can be a transceiver, such as an optical transceiver 26*a* or any alternative electrical component such as a copper cable. The electrical connector 20 is configured to be mated with at least one complementary electrical component, such as the complementary electrical component 23, which can include a first substrate 27. In accordance with the illustrated embodiment, the optical transceiver 26*a* can be a first optical transceiver, and the at least one complementary electrical component 23 can further include a second transceiver, such as a second optical transceiver 26*b* that includes a second substrate 28. The electrical connector 20 is configured to be mounted to a third substrate 29 which can be provided as a printed circuit board (PCB). The electrical connector 20 can be a serial attached small computer system interface (SCSI), also known as a mini SAS/HD connector. The first, second, and third substrates 27, 28, and 29 can each be configured as a printed circuit board, such that the first and second substrates 27 and 28 can be placed in electrical communication with the third substrate 29 when the electrical connector 20 is mated with the first and second substrates 27 and 28, and mounted to the third substrate 29.

The electrical connector 20 includes a plurality of electrical contacts 46 and a connector housing 30 that is dielectric or electrically insulative and supports the electrical contacts 46. When the electrical connector 20 is mounted to the third substrate 29, the electrical contacts 46 are electrically connected to complementary electrical traces of the third substrate 29, thereby placing the electrical connector 20 in electrical communication with the third substrate 29. When the electrical connector 20 is mated to at least one optical transceiver, such as the first and second optical transceivers 26*a-b*, the electrical contacts 46 are placed in electrical communication with complementary electrical traces of a respective substrate of the at least one optical transceiver, such as the first and second substrates 27 and 28 of the first and second optical transceivers 26*a-b*, respectively, thereby placing the electrical connector 20 in electrical communication with the at least one substrate, such as the first and second substrates 27 and 28. Accordingly, when the electrical connector 20 is mounted to the third substrate 29 and mated with the first and second optical transceivers 26*a-b*, each of the first and second substrates 27 and 28 is placed in electrical communication with the third substrate 29.

The connector housing 30 defines a top end 32 and an opposed bottom end 34, a front end 36 and an opposed rear end 38, and opposed sides 40. In accordance with the illustrated embodiment, the opposed sides 40 are spaced apart along a longitudinal direction L, the front end rear ends 36 and 38 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the connector housing 30 may vary during use. In accordance with the illustrated embodiment, the connector housing 30 is illustrated as elongate in the lateral direction. Furthermore, the electrical connector 20 defines a row direction 51 that can extend along the longitudinal direction L, parallel to the direction of elongation of the third substrate 29, and a column direction 55 that is substantially perpendicular to the row direction 51 and can extend along the transverse direction T, and thus substantially perpendicular to the direction of elongation of the third substrate 29.

The connector housing 30 defines a mating interface 42 disposed proximate to the front end 36 and a mounting interface 44 disposed proximate to the bottom end 34. The mounting interface 44 is configured to operatively engage the third substrate 29 when the electrical connector 20 is mounted to the third substrate 29, and the mating interface 42 is configured to operatively engage the first and second substrates 27 and 28 when the electrical connector 20 is mated with the respective first and second optical transceivers 26*a-b*. The connector housing 30 defines at least one receptacle 45*a* such as a first or upper receptacle and a second or lower receptacle 45*b* that is spaced from the first or upper receptacle 45*a* along the transverse direction T. The receptacles 45*a-b* can be disposed at mating interface 42, and configured to receive corresponding electrical components, such as the first and second optical transceivers 26*a* and 26*b*, respectively. Each of the receptacles 45*a* and 45*b* extends into the front end 36 of the connector housing 30. The first receptacle 45*a* extends along a first or upper row 47, and the second receptacle 45*b* extends along a second or lower row 49 that is spaced below the first or upper row 47 along the transverse direction T. Thus, the upper and lower rows 47 and 49 are spaced along the column direction 55. Each of the first or upper row 47 and the second or lower row 49 are elongate along the row direction 51, and thus extend substantially parallel to each other. Each of the receptacles 45*a-b* extends laterally into the front end 36, and is sized such that respective edges of the first and second substrates 27 and 28 are configured to be inserted into the receptacles 45*a-b* of the first and second rows 47 and 49, respectively. Thus, the first and second substrates 27 and 28 can be described as vertically stacked when mated to the electrical connector 20. The electrical connector 20 can be described as an edge card connector in that the electrical connector 20 is configured to mate with the edges of the first and second substrates 27 and 28. For instance, the receptacles 45*a* and 45*b* are configured to receive respective edge cards, such as the first and second substrates 27 and 28.

Referring now to FIGS. 1A-3D, the electrical connector 20 includes a plurality of electrical contacts 46 that are electrically conductive and supported by the connector housing 30. In accordance with the illustrated embodiment, the electrical connector 20 includes a plurality first of leadframe assemblies 48 that each include a respective first leadframe housing 50 and respective select ones of the plurality of electrical contacts 46 that are supported by the first leadframe housing 50. The first leadframe housing 50, which can be a dielectric or electrically insulative material that each retains a plurality of the electrical contacts 46. The electrical contacts 46 are signal contacts in accordance with the illustrated embodiment. Thus, the leadframe assemblies 48 can be referred to as signal leadframe assemblies. The first plurality of leadframe assemblies 48 can be provided as insert molded leadframe assemblies (IMLAs) whereby the first leadframe housing 50 is overmolded onto the respective electrical contacts 46. The leadframe assemblies 48 are supported by the connector housing 30 and arranged such that adjacent leadframe assemblies 48 are spaced along the row direction 51.

The first leadframe assemblies 48 can include at least one first select leadframe assembly 48*a* of the plurality of first leadframe assemblies 48, such as a plurality of first select leadframe assemblies 48*a* of the first leadframe assemblies 48, and at least one second select leadframe assembly 48*b* of the plurality of first leadframe assemblies 48, such as a plurality of second select leadframe assemblies 48*b* of the plurality of first leadframe assemblies 48. The first leadframe assemblies 48 can be arranged in leadframe pairs 76 (see FIG. 6) that each include one of the first select leadframe assemblies 48*a* and one of the second select leadframe assemblies 48*b* that are disposed adjacent to each other along the row direction 51.

The first leadframe housings 50 each define a lower mounting end 58 and an opposed upper end 60 that is spaced from the lower mounting end 58 along the transverse direction T, a front mating portion 62 and an opposed rear end 64 that is spaced from the front mating portion 62 along the lateral direction A, and opposed first and second opposed sides 66 that are spaced from each other along the longitudinal direction L. Each of the respective electrical contacts 46 of each leadframe assembly 48 defines a mating portion 70 that extends laterally forward from the front mating portion 62 of the corresponding leadframe housing 50. Each of the respective electrical contacts 46 of each leadframe assembly 48 further defines a mounting portion 72 that extends down from the lower mounting end 58 of the corresponding leadframe housing 50. The mating portions 70 are configured to electrically mate with the complementary electrical component 23 as described below. The mounting portions 72 are illustrated as eye-of-the-needle tails that can be press-fit into complementary apertures extending into or through the third substrate 29. Alternatively, the mounting portions 72 can be configured to be surface mounted to the respective third substrate 29, or otherwise mounted to the third substrate 29 as desired so as to place the electrical contacts 46 in electrical communication with corresponding electrical traces of the third substrate 29. Thus, the electrical connector 20 can be mated with the electrical component 23 so as to place the third substrate 29 in electrical communication with at least one substrate to which the electrical connector 20 is mated, such as the first and second substrates 27 and 28.

Each of the electrical contacts 46 defines an intermediate portion 74 that extends between the mating portion 70 and the mounting portion 72. The intermediate portion 74 can define a first segment 74*a* and a second segment 74*b* that are inline with the mating portion 70 and mounting portion 72, respectively, and a joint 74*c* that is coupled to the segments 74*a* and 74*b*. The first and second segments 74*a* and 74*b* and the joint 74*c* can be integral with each other. In accordance with one embodiment, the joint 74*c* can define a right-angle between the segments 74*a* and 74*b* (FIGS. 2B and 3B) or can define an oblique intermediate segment that is connected between the segments 74*a* and 74*b* (FIGS. 2C and 3C) so as to define an angle with respect to at least one or both of the segments 74*a* and 74*b* that is greater than 90 degrees. The joint 74*c* can alternatively be curved or alternatively shaped as desired such that the mating portion 70 and mounting portion 72 are in electrical communication. Furthermore, each of the first and second segments 74*a* and 74*b* can extend substantially straight, curved, or can define any suitable direction of extension as desired.

The electrical contacts 46 of each leadframe assembly 48 are spaced along the generally vertical or transverse column direction 55. Each of the electrical contacts 46 defines a pair of opposed broadsides 56 that are spaced apart along a first direction, such as the row direction, and a pair of opposed edges 54 that are spaced apart in a second direction that is substantially perpendicular to the first direction. The second direction can extend along the column direction 55. In accordance with the illustrated embodiment, the edges 54 are substantially parallel to each other and laterally spaced, and the broadsides 56 are substantially parallel to each other. The edges 54 and broadsides 56 are substantially perpendicular to each other, such that the electrical contacts 46 define a substantially rectangular cross-section. The edges 54 define a first length sufficient so as to be connected between the opposed broadsides 56 along a direction that is substantially perpendicular to the broadsides 56. The broadsides 56 define a second length sufficient so as to be connected between the opposed edges 54 along a direction that is substantially perpendicular to the edges 54. The first length of the edges 54 is less than the second length of the broadsides 56, and the lengths of the edges 54 and broadsides can differ or be the same among the electrical contacts 46. The edges 54 of the electrical contacts 46 of each leadframe assembly 48 can face each other along the column direction 55. The broadsides 56 of the electrical contacts of adjacent leadframe assemblies 48 can face each other along the row direction 51.

Figure 6:
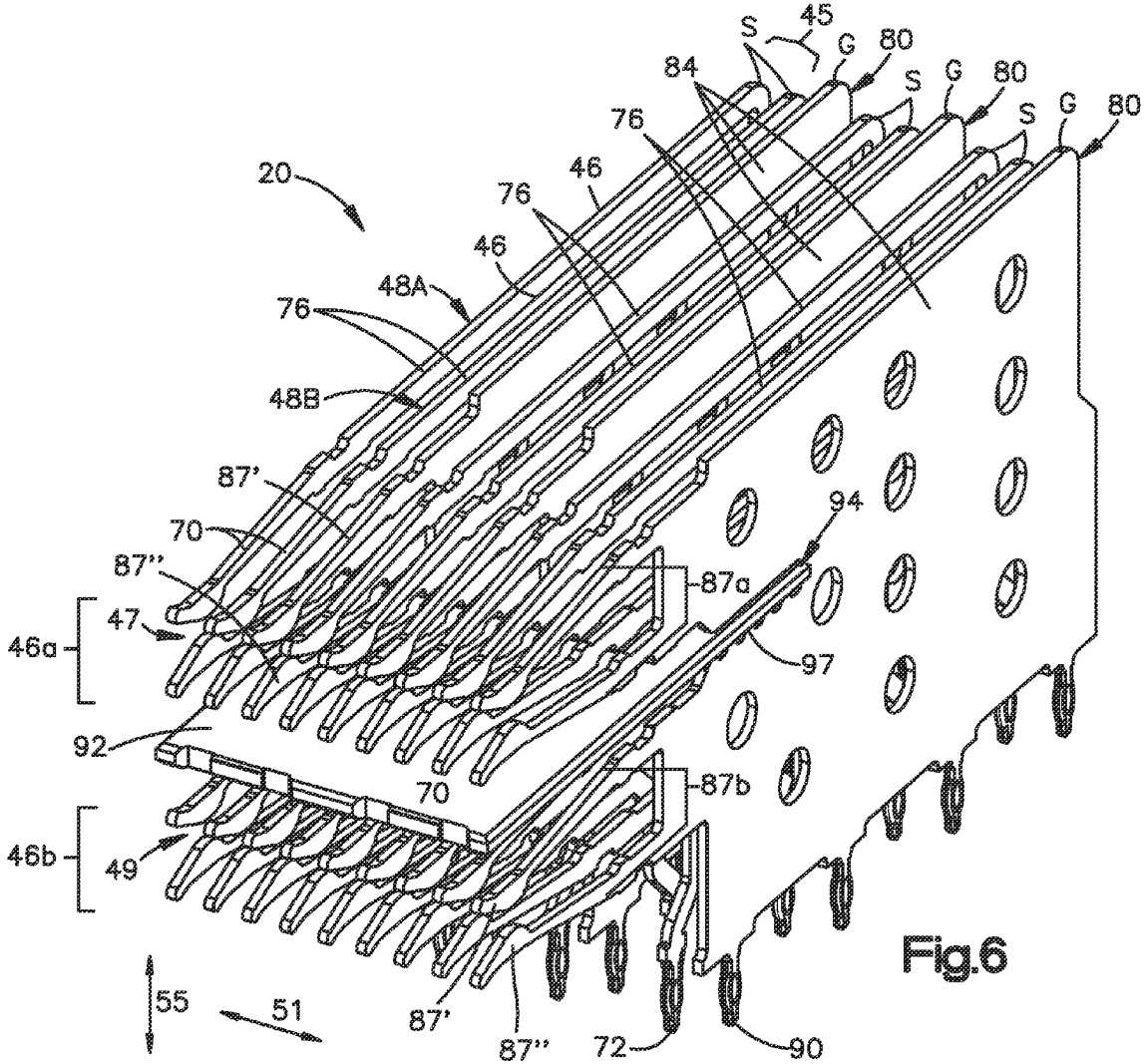
FIG. 6 is a perspective view of the electrical connector illustrated in FIG. 1, showing the connector housing and leadframe housings removed.

Referring also to FIG. 6, the electrical connector 20 defines pairs 76 of adjacent first and second select leadframe assemblies 48*a* and 48*b* such that aligned contacts 46 of the adjacent leadframe assemblies 48 along the row direction 51 define differential signal pairs 45. Otherwise stated, adjacent electrical contacts 46 of the respective pairs 76 of adjacent leadframe assemblies 48 define differential signal pairs. Thus, because the electrical contacts 46 of the pairs of adjacent leadframe assemblies 48 whose broadsides 56 face each other define differential signal pairs, the electrical contacts 46 can be said to be broadside-coupled. Furthermore, because adjacent electrical contacts 46 along the row direction 51 define differential signal pairs, the electrical connector 20 can be referred to as a row-based electrical connector.

The leadframe assemblies 48 can include as many electrical contacts 46 as desired that are spaced along the column direction 55, such that pairs 76 of the electrical contacts 46 of adjacent leadframe assemblies 48 can define differential signal pairs as desired. In accordance with the illustrated embodiment, each leadframe assembly 48 defines at least one pair of electrical contacts, such as a first or upper pair 46*a* of electrical contacts 46, and a second or lower pair 46*b* of electrical contacts 46. For instance, each pair 46*a* and 46*b* can include a first electrical contact 46' and a second electrical contact 46". When the leadframe assemblies 48 are supported by the connector housing 30, the mating portions 70 of the first and second electrical contacts 46' and 46" extend into the receptacle 45*a* that is elongate along the first row 47, and the mating portions 70 of the first and second electrical contacts 46' and 46" of the lower pair 46*b* extend into the second receptacle 45*b* that is elongate along the second row 49.

The mating portions 70 of each of the first and second electrical contacts 46' and 46" of the upper pair 46*a* are spaced apart along the transverse direction T in the first receptacle 45*a*, and are placed in electrical communication with opposed upper and lower surfaces of the first substrate 27 when the first substrate 27 of the first optical transceiver 26*a* is inserted into the first receptacle 45*a*. The mating portions 70 of each of the first and second electrical contacts 46'*a* and 46" are spaced apart along the transverse direction T in the receptacle 45*b* of the lower row 49, and are placed in electrical communication with opposed surfaces of the second substrate 28 when the second substrate 28 is inserted into the second receptacle 45*b*. In this regard, the mating portions 70 of first and second ones of the contacts 46 of a corresponding leadframe assembly 48 define at least one substrate-receiving gap that is configured to receive a substrate of the complementary electrical component 23 so as to place the complementary electrical component 23 in electrical communication with the third substrate 29. For instance, the mating portions 70 of the first and second electrical contacts 46' and 46" of the upper pair 46*a* define a first substrate-receiving gap 53*a* that is configured to receive the first substrate 27 such that the mating portions 70 of the first and second electrical contacts 46' and 46" of the upper pair 46*a* engage opposed surfaces of the first substrate 27. The mating portions 70 of each of the first and second electrical contacts 46' and 46" of the lower pair 46*b* define a second substrate-receiving gap 53*b* that is configured to receive the second substrate 28 such that the mating portions 70 of each of the first and second electrical contacts 46' and 46" of the lower pair 46*b* engage opposed surfaces of the second substrate 28.

The respective electrical contacts 46 of adjacent leadframe assemblies 48, for instance electrical contacts 46 that are aligned along the row direction 51, can define differential signal pairs. In accordance with the illustrated embodiment, each of the first and second electrical contacts 46' and 46" of each of the upper and lower pairs 46*a* and 46*b*, respectively, of a first one of the leadframe assemblies 48 and each of the first and second electrical contacts 46' and 46" of each of the upper and lower pairs 46*a* and 46*b*, respectively, of a second one of the leadframe assemblies 48 that is adjacent the first one of the leadframe assemblies 48 define respective differential signal pairs. For instance, the first electrical contact 46' of the upper pair 46*a* of a first one of the leadframe assemblies 48 and the first electrical contact 46' of the upper pair 46*a* of a second one of the leadframe assemblies 48 that is adjacent the first one of the leadframe assemblies 48 can define a first differential signal pair. Furthermore, the second electrical contact 46" of the upper pair 46*a* of the first one of the leadframe assemblies 48 and the second electrical contact 46" of the upper pair 46*a* of the second one of the leadframe assemblies 48 can define a second differential signal pair. Furthermore still, the first electrical contact 46' of the lower pair 46*b* of the first one of the leadframe assemblies 48 and the first electrical contact 46' of the lower pair 46*b* of the second one of the leadframe assemblies 48 can define a third differential signal pair. Furthermore still, the second electrical contact 46" of the lower pair 46*b* of the first one of the leadframe assemblies 48 and the second electrical contact 46" of the lower pair 46*b* of the second one of the leadframe assemblies 48 can define a fourth differential signal pair. In accordance with the illustrated embodiment, the first one of the leadframe assemblies 48 can define one of the first select leadframe assemblies 48*a*, and the second one of the leadframe assemblies 48 can define one of the second select leadframe assemblies 48*b*.

Thus, it should be appreciated that adjacent electrical contacts 46 that define a differential signal pair are spaced apart along the row direction 51, such that the respective broadsides 56 face each other. Accordingly, the electrical contacts 46 that define differential signal pairs can be said to be broadside coupled. In accordance with the illustrated embodiment, each pair 76 of adjacent leadframe assemblies 48 can define four broadside coupled differential signal pairs, a first pair of which are disposed in the first row 47 of receptacles 45*a* that receives the first substrate 27 of the first optical transceiver 26*a*, and a second pair of which are disposed in the second row 49 of receptacles 45*b* that receives the second substrate 28 of the second optical transceiver 26*b*. It should be appreciated that the leadframe assemblies 48 can include any number of electrical contacts 46 as desired, and the electrical connector 20 can include any number of receptacles at the mating interface 42 as desired.

Because the mating portions 70 of the upper and lower pairs 46*a* and 46*b* of the electrical contacts 46 are arranged so as to receive the first and second substrates 27 and 28, respectively, the electrical contacts 46 can be referred to as receptacle contacts and the electrical connector 20 can be referred to as a receptacle connector. It should be appreciated, however that the electrical connector 20 can be constructed in accordance with any suitable alternative embodiment without departing from the present disclosure. For instance, the electrical connector 20 can alternatively be constructed as a header connector whose electrical contacts 46 are received by complementary electrical contacts of the complementary electrical component 23. Furthermore, because the mating portions 70 of the electrical contacts 46 are oriented substantially perpendicular with respect to the mounting portions 72, the electrical connector 20 can be described as a right-angle connector. Alternatively, the electrical connector 20 can be configured as a vertical connector whose mating portions 70 are oriented substantially parallel with respect to the mounting portions 72. For instance, the mounting portions 72 can extend rearward from the rear ends 64 of the first leadframe housings 50.

While all of the electrical contacts 46 disposed in the leadframe assemblies 48 are signal contacts in accordance with the illustrated embodiment, it should be appreciated that one or more of the electrical contacts 46 can be ground contacts, and can be positioned such that the ground contacts of the pairs 76 of adjacent leadframe assemblies 48 are aligned along the row direction 51, or alternatively positioned as desired. For instance, the ground contacts can be disposed between the upper and lower pairs 46*a* and 46*b*. It should be further appreciated that in accordance with alternative embodiments, the electrical contacts 46 can define single-ended signal contacts. Alternatively still, the electrical connector 20 can be a column-based electrical connector whereby adjacent electrical contacts 46 along the column direction 55 of a given leadframe assembly 48 define differential signal pairs.

Figure 4A:
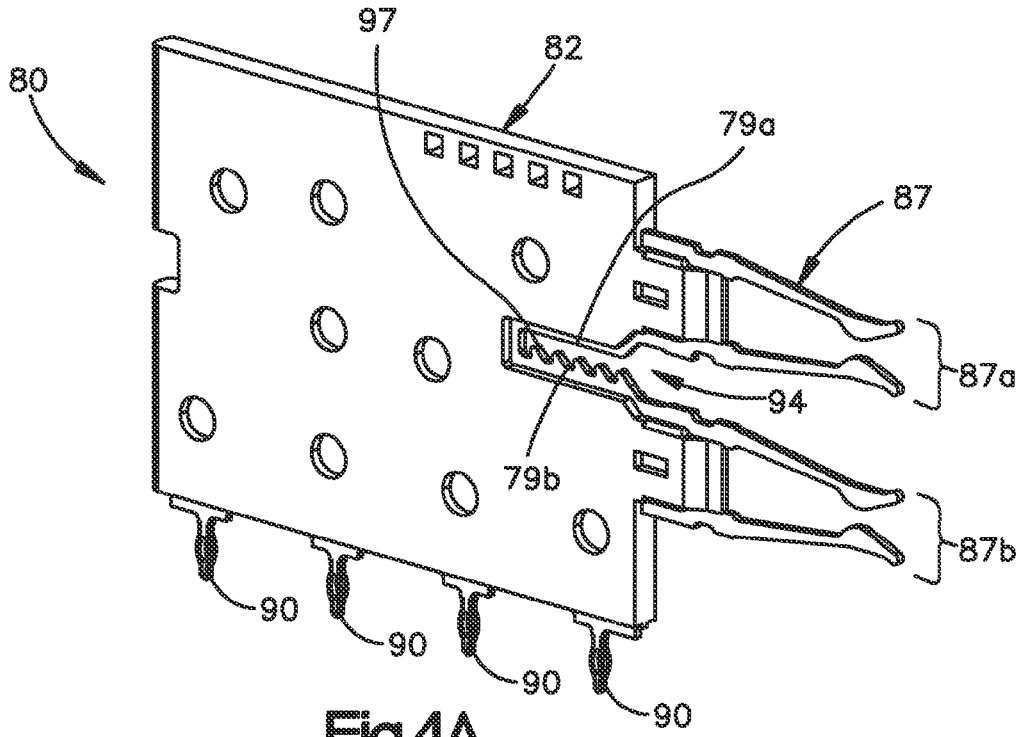
FIG. 4A is a perspective view of a third leadframe assembly of a third plurality of leadframe assemblies of the electrical connector illustrated in FIG. 1, wherein the third leadframe assembly includes a third leadframe housing and an electrical ground plate supported by the third leadframe housing.
Figure 4B:
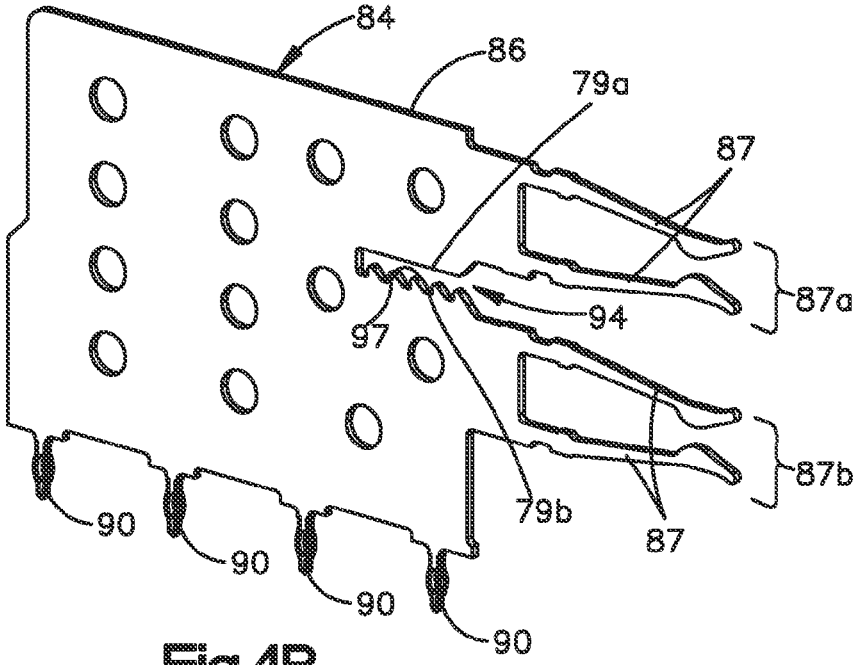
FIG. 4B is a perspective view of the electrical ground plate illustrated in FIG. 4A.
Figure 5:
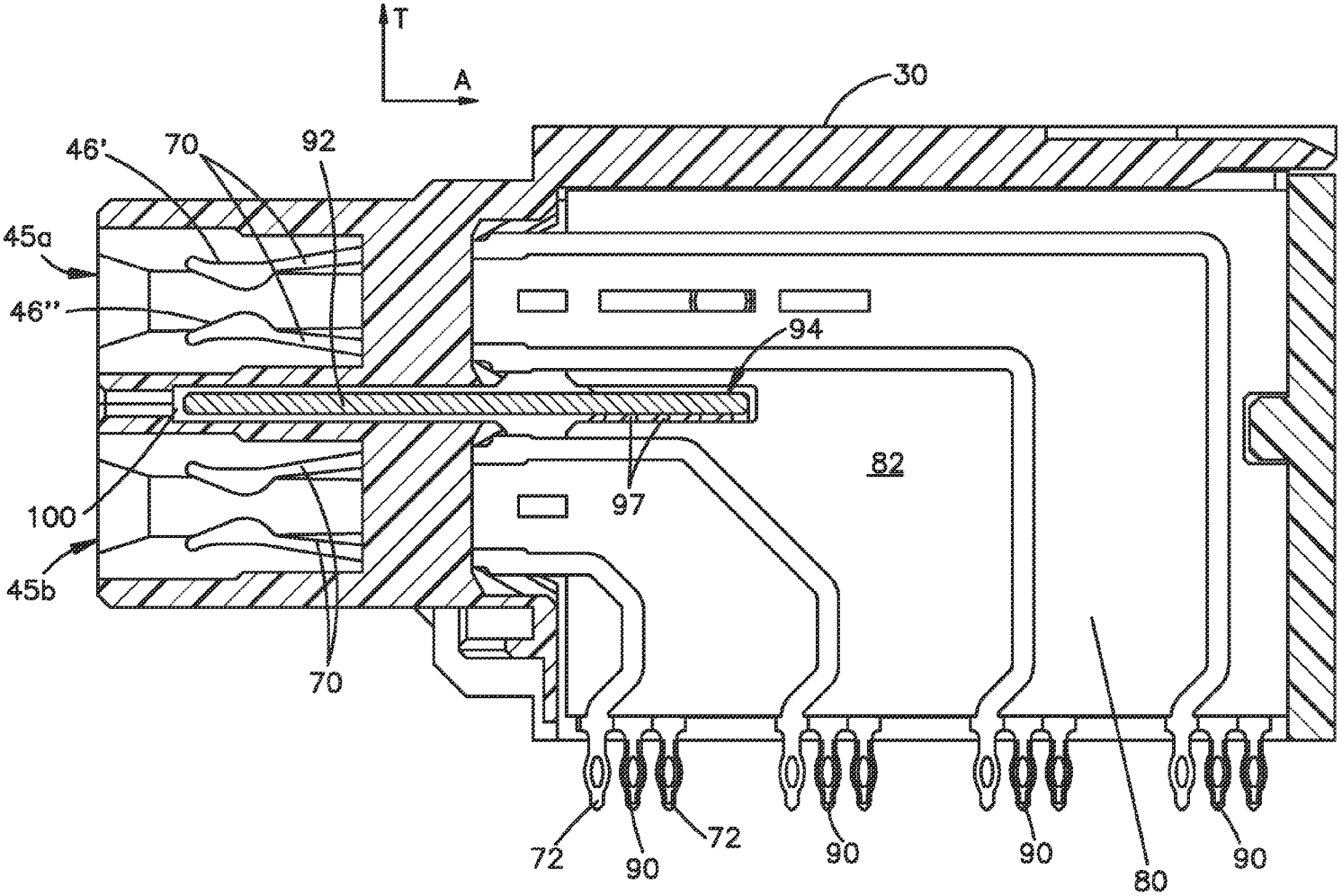
FIG. 5 is a sectional side elevation view of the electrical connector illustrated in FIG. 1.

Referring now to FIGS. 4-6, the electrical connector 20 includes a plurality of second leadframe assemblies 80 that are disposed between adjacent pairs 76 of adjacent first and second select leadframe assemblies 48*a* and 48*b*. Each of the third leadframe assemblies 80 includes an electrically conductive plate 84 that defines a plate body 86, and a second leadframe housing 82, which can be a dielectric or electrically insulative material, that supports the electrically conductive plate body 86, which can be metallic or otherwise electrically absorptive. For instance, the plate body 86 can be made from an electrically absorptive lossy material. Thus, the plate body 86 can be made from a metallic or non-metallic material. In accordance with certain embodiments, the third leadframe assemblies 80 can be insert molded leadframe assemblies (IMLAs) whereby the plate body 86 of the plate 84 is overmolded by the second leadframe housings 82. Each plate body 86 can be oriented in a vertical plane that is defined by the transverse T and lateral A directions, and extend vertically and laterally a sufficient distance so as to overlap at least part up to all of at least one up to all of the adjacent electrical contacts 46 with respect to the row direction 51. Thus, a line extending along the row direction 51 passes through at least one of the electrical contacts 46 of the leadframe assembly 48 that is adjacent the plate body 86 along the row direction, and further passes through the plate body 86. The leadframe assemblies 48 and 80 can be supported by the connector housing 30 and arranged such that the leadframe assemblies 80 and respective plates 84 are disposed between adjacent pairs 76 of adjacent leadframe assemblies 48, such as adjacent first and second select leadframe assemblies 48*a* and 48*b*. Accordingly, a line extending along the row direction 51 that passes through a broadside coupled differential signal pair of electrical contacts 46 of a corresponding pair 76 of leadframe assemblies 48 can pass through the plate 84 after passing through the differential signal pair. Thus, the plates 84 can be disposed between adjacent pairs 76 of leadframe assemblies 48. Further, the plates 84 can define metallic electromagnetic shields that are disposed between at least one pair of differential signal pairs defined by the adjacent pairs 76 of leadframe assemblies 48. As described above, each pair 76 of leadframe assemblies 48 can be defined by a first select leadframe assembly 48*a* and a second select leadframe assembly 48*b*.

Furthermore, at least one of the plates 84 up to all of the plates 84 can define a plurality of mating portions 87 that can be aligned with the mating portions 70 of respective of the electrical contacts 46 along the row direction 51. In accordance with the illustrated embodiment, the mating portions 87 can be configured as fingers that project laterally forward from the respective plate bodies 86. The mating portions 87 can be shaped substantially identically with the aligned mating portions 70 of the electrical contacts 46 as illustrated, or can be shaped differently as desired. In accordance with the illustrated embodiment, each plate 84 defines at least one pair of mating portions 87, such as a first or upper pair 87*a* of mating portions 87 and a second or lower pair 87*b* of mating portions that are electrically commoned, or electrically connected, together via the respective plate body 86. Thus, an electrical path is established between each of the mating portions 87 through the plate body 86. For instance, each pair 87*a* and 87*b* of mating portions 87 can include a first mating portion 87' and a second mating portion 87". When the plates 84 are supported by the connector housing 30, each of the first and second fingers mating portions 87' and 87" of the upper pair 87*a* can extend into the receptacle 45*a* that is elongate along the first row 47, and the each of the first and second mating portions 87' and 87" of the lower pair 87*b* extend into the second receptacle 45*b* that is elongate along the second row 49. Thus, the mating portions 87 of the upper pair 87*a* can be aligned with the mating portions 70 of the electrical contacts 46 of the upper pair 46*a* along the row direction 51, and can be shaped substantially identically to the mating portions 70 of the electrical contacts 46 of the upper pair 46*a* of each leadframe assembly 48. Likewise, the mating portions 87 of the lower pair 87*b* are aligned with the electrical contacts 46 of the lower pair 46*b* along the row direction 51, and can be shaped substantially identically to the mating portions 70 of the electrical contacts 46 of the lower pair 46*b* of each leadframe assembly 48.

Thus, the mating portions 87 of the upper pair 87*a*, and the mating portions 87 of the lower pair 87*b*, are spaced apart a distance equal to the mating portions 70 of the electrical contacts 46 of both the upper pair 46*a* in the upper receptacle 45*a*, and the lower pair 46*b* in the receptacle 45*b*, respectively, along the row direction 51. Accordingly, during operation, the first receptacle 45*a* is configured to receive the first substrate 27, such that opposed surfaces of the first substrate 27 are placed in electrical communication with both 1) the first and second mating portions 87' and 87", respectively, of the upper pair 87*a*, and 2) the mating portions 70 of the first and second electrical contacts 46' and 46" of the upper pair 46*a* of electrical contacts 46. Likewise, during operation, the lower receptacle 45*b* is configured to receive the second substrate 28, such that opposed surfaces of the second substrate 28 are placed in electrical communication with both 1) the first and second mating portions 87' and 87", respectively, of the lower pair 87*b*, and 2) the mating portions 70 of the first and second electrical contacts 46' and 46" of the lower pair 46*b* of electrical contacts 46.

At least one of the plates 84 up to all of the plates 84 can further define a plurality of mounting portions 90, which can be configured as fingers that are spaced along the lateral direction A and project down from the respective plate bodies 86. The mounting portions 90 are electrically commoned together and further electrically commoned with the mating portions 87 via the plate body 86. Thus, each of the plates 84 establish an electrical path between the respective mounting portions 90 along the corresponding plate body 86 that supports the mounting portions 90. Furthermore, each of the plates 84 establishes an electrical path from the mating portions 87 to the mounting portions 90 along the corresponding plate body 86. As illustrated in FIG. 6, the mounting portions 90 of the plates 84 can be positioned between the mounting portions 72 of the electrical contacts 46 of the first and second select leadframe assemblies 48*a* and 48*b* along the lateral direction A. The mounting portions 90 can be shaped substantially identically to the mounting portions 72 of the electrical contacts 46. The mounting portions 90 can be configured as eye-of-the-needle tails that can be press-fit into complementary apertures extending into or through the third substrate 29. Alternatively, the mounting portions 90 can be configured to be surface mounted to the respective third substrate 29. Thus, the plates 84 further define ground contacts G that are connected between the third substrate 29 and at least one or both of the first and second substrates 27 and 28 when the electrical connector 20 is mated to the electrical component 23. In this regard, the plates 84 can be referred to as conductive ground shields, and the leadframe assemblies 80 can be referred to as ground leadframes. Furthermore the electrical contacts 46 of the leadframe assemblies 48 can define signal contacts (S). Accordingly, the electrical connector 20 can define a repeating S-S-G pattern or any suitable alternative pattern along the row direction 51.

Referring now to FIG. 6 in particular, the electrical connector 20 can further include a ground commoning member 92 that can be configured as an electrically conductive ground commoning plate that can be metallic or electrically absorptive in accordance with the illustrated embodiment. For instance, the ground commoning member 92 can be made from an electrically absorptive lossy material. Thus, the ground commoning member 92 can be made from a metallic or non-metallic material. The ground commoning member 92 can be electrically connected to the plates 84 at the mating interface 42, and electrically isolated from the electrical contacts 46 of the first leadframe assemblies 48. Thus, the ground commoning member is electrically isolated from the electrical signal contacts S of the first leadframe assemblies, and thus further isolated from each of the differential signal pairs defined by adjacent ones of the first leadframe assemblies 48, such as the first and second select ones 48*a* and 48*b* of the first leadframe assemblies 48. Thus, it can be said that the electrical connector 20 includes at least one first plate 84, such as a first plurality of plates 84 that are disposed between adjacent pairs of broadside coupled differential signal contacts S, and a second plate or ground commoning member 92 that electrically connects the first plurality of plates 84 at the mating interface 42 so as to establish an electrical path between and including the first plurality of plates 84 and the ground commoning member 92, thereby placing each of the plates 84 that are connected to the ground commoning member 92 in electrical communication. It should be appreciated that at least two up to all of the plates 84 can be connected to the ground commoning member 92 and placed in electrical communication with each other. It should be appreciated that the ground commoning member 92 can be configured as a plate as illustrated, or otherwise configured as desired.

Referring now to FIGS. 4A-6, in accordance with the illustrated embodiment, at least two up to all of the leadframe assemblies 80 can define a respective first plurality of slots, such as respective retention slots 94 that are configured to receive and retain the electrically ground commoning member 92. In accordance with the illustrated embodiment, the each retention slot 94 extends rearwardly along the lateral direction A into the front end of the respective leadframe housing 82, and further extends rearwardly along the lateral direction A into the front end of the respective plate bodies 86. In particular, the retention slots 94 can extend laterally into the plate bodies 86 at a location between the upper pair 87*a* of mating portions 87 and the lower pair 87*b* of mating portions 87. The plate body 86 can define a first or upper surface 79*a* and a second or lower surface 79*b* that is spaced from the first or upper surface 79*a* along the transverse direction T. The first and second surfaces 79*a* and 79*b* at least partially define the retention slots 94, and can be spaced at a distance sufficient so as to define a thickness in the transverse direction T that is substantially equal to or slightly less than that of the ground commoning member 92 such that the corresponding leadframe assemblies 80 are configured to securely retain the ground commoning member 92 so as to maintain electrical communication between the ground commoning member 92 and the respective plate body 86.

In accordance with the illustrated embodiment, the plate body 86 can further include at least one retention member such as a plurality of teeth 97 that are defined by at least one or both of the first and second surfaces 79*a* and 79*b*, and extend along the transverse direction toward the other of the first and second surfaces 79*a* and 79*b*. For instance, as illustrated, the second surface 79*b* defines a plurality of teeth 97 that project toward the first surface 79*a*. The teeth 97 can define gripping surfaces that engage the ground commoning member 92 when the ground commoning member 92 is received in the corresponding retention slot 94. Thus, the ground commoning member 92 can be friction fit in the retention slots 94 between the teeth 97 and the opposed first surface 79*a* so as to electrically connect the ground commoning member 92 to the plates 84. It can thus be said that the teeth 97, and thus the retention member, provide a retention force against the ground commoning member 92 that retains the ground commoning member 92 in the respective retention slots 94. Alternatively, the retention member can be configured as at least one spring beam such as a plurality of electrically spring beams that are connected, for instance discretely or integrally, with the first and second side surfaces 79*a* and 79*b*. The spring beams can deflect and make contact with the ground commoning member 92 when the ground commoning member is received in the corresponding retention slots 94, thereby providing a retention force that retains the ground commoning member 92 in the retention slots 94. When the ground commoning member 92 defines a plate, the ground commoning member 92 and the plates 84 are oriented orthogonal with respect to each other when the ground commoning member 92 is disposed in the retention slots 94. For instance, the ground commoning member 92 can elongate along a first plane, such as a horizontal plane defined by the longitudinal and lateral directions L and A, while the plates 84 can be elongated along a second plane, such as a vertical plane defined by the lateral and transverse direction A and T, such that the first and second planes are substantially orthogonal to each other.

Referring also to FIGS. 2-3, at least one up to all of the leadframe assemblies 48 can define a respective second plurality of slots 98 that extend laterally into the front ends of the respective leadframe housings 50, at a location between the electrical contacts 46 of the upper pairs 46*a* and the electrical contacts 46 of the lower pairs 46*b*. Thus, the slots 98 can be offset from each of the electrical contacts 46 of the respective leadframe assembly 48. The slots 98 extend in a direction parallel to the retention slots 94 of the leadframe assemblies 80, and aligned with the retention slots 94 along the row direction 51. Thus, a line extending along the row direction can extend through both the slots 98 and the retention slots 94 when the leadframe assemblies 48 and 80 are supported by the connector housing 30 for operation. The slots 98 extend into the front ends of the first leadframe housings 50 along the lateral direction A to a depth that is spaced forward of the intermediate portions 74 of the electrical contacts 46. The slots 98 define a thickness in the transverse direction T that can be substantially equal to that of the retention slots 94, and thus can be substantially equal to or less than the transverse thickness of the ground commoning member 92. Accordingly, the ground commoning member 92 can be press-fit into the slots 98, and thus retained in the slots 98 by the respective leadframe housing 50, without contacting the electrical contacts 46. Alternatively, the thickness slots 98 of the leadframe assemblies 48 can be greater than that of the ground commoning member 92 such that the ground commoning member 92 is received in the slots 98, but not retained in slots 98 by the first leadframe housing 50. Rather, the retention slots 94 can retain the ground commoning member 92. Alternatively still, the leadframe assemblies 48 can be devoid of the slots 98, and the ground commoning member 92 can be notched so as to define slots that receive the first leadframe housing 50 when the ground commoning member 92 is received in the retention slots 94 of the leadframe assemblies 80.

As further illustrated in FIG. 5, the connector housing 30 can define a pocket 100 that is sized to receive the ground commoning member 92, such that the ground commoning member 92 is encapsulated by the housing 30, for instance at the front end 36 of the housing 30. For instance, the front end of the ground commoning member 92 is recessed with respect to the front end of the connector housing 30. Thus, the ground commoning member 92 does not extend forward from the mating interface 42, and thus does not extend forward from the receptacles 45*a* and 45*b* along a lateral mating direction along which the electrical connector 20 is configured to be mated to the complementary electrical components 23. Furthermore, the ground commoning member 92 can be aligned with at least a portion of the mating portions 70 and 87 of the electrical contacts 46 and the conductive plate 84, respectively, with respect to the transverse direction T. Thus, a line extending along the transverse direction T, which is substantially perpendicular to the mating direction, can extend through the mating portions 70 and the ground commoning member 92, and a line and 87 extending along the transverse direction T, which is substantially perpendicular to the mating direction, can extend through the mating portions 87 and the ground commoning member 92. The ground commoning member 92 can be configured as a plate that is elongate along a plane that is substantially parallel to the mounting interface 44, and thus substantially parallel to the third substrate 29. While the ground commoning member 92 is illustrated as including a single plate that spans the longitudinal length of the mating portions 70 and the mating portions 87 of the leadframe assemblies 48 and 80, respectively, it should be appreciated that the plate 92 can alternatively be segmented into discrete plate segments as desired that each electrically common a select number less than all of the electrically conductive plates 84.

As described above, the at least one complementary electrical component 23 can be configured as a first optical transceiver 26*a* that carries the first substrate 27, and a second transceiver 26*b* that carries the second substrate 28 that are configured to be inserted into the rows 47 and 49 of receptacles 45*a-b*, respectively. During operation, when the electrical connector 20 is mated with the respective first and second substrates 27 and 28 of the transceivers 26*a-b*, the differential signal pairs defined by the upper pairs 46*a* of electrical contacts 46 can be configured to transmit signal data to the complementary first substrate 27 (e.g., from the third substrate 29), and the differential signal pairs defined by the lower pairs 46*b* of electrical contacts 46 can be configured to receive signal data from the complementary second substrate 28 and transmit the received signal data to the third substrate 29. Alternatively, the differential signal pairs defined by the upper pairs 46*a* of electrical contacts can be configured to receive signal data from the complementary first substrate 27 and transmit the received signal data to the third substrate 29, and the differential signal pairs of the lower pairs 46*b* of electrical contacts 46 are configured to transmit signal data to the complementary second substrate 28 (e.g., from the third substrate 29).

Thus, it can be said that at least one of the upper and lower differential signal pairs defined by adjacent leadframe assemblies 48 of a given pair 76 of leadframe assemblies 48 is configured to transmit signal data along a direction from the mounting interface 44 toward the mating interface 42, and the other of the upper and lower differential signal pairs of a given pair 76 of leadframe assemblies 48 is configured to transmit signal data along a direction from the mating interface 42 toward the mounting interface 44. Thus, the electrical contacts 46 on one side of the ground commoning member 92 can be configured to transmit electrical signals from the third substrate 29 to the respective transceiver 26*a* or 26*b*, and the electrical contacts 46 on an opposite side of the ground commoning member 92 can be configured to transmit electrical signals from the respective transceiver 26*a* or 26*b* to the third substrate 29. The ground commoning member 92 can provide an electromagnetic shield disposed between the electrical contacts 46 that transmit electrical signals to the respective optical transceiver and the electrical contacts 46 that receive electrical signals from the respective transceiver.

Furthermore, while the connector 20 is configured to place the third substrate 29 in electrical communication with one or more transceivers 26*a-b*, it should be appreciated that the at least one complementary electrical component 23 can define at least one electrical component as desired that includes or is coupled to at least one substrate, and a complementary electrical device, such as the third substrate 29 or alternatively electrical device, at another end.

During operation, the electrical connector 20 has been found to achieve an impedance of approximately 100 Ohms+/− about 15% with a risetime of approximately 30 picoseconds. The electrical connector 20 has further been found to cross −40 decibel (dB) near-end crosstalk at an operating frequency of about 12 gigahertz (GHz). Thus, each differential signal pair achieves data transfer rates of approximately 25 gigabits/second before reaching −40 dB near-end crosstalk. The electrical connector 20 has further been found to cross −40 decibel (dB) far-end crosstalk at an operating frequency of between approximately 10-11 GHz. The electrical connector 20 has further been found to cross an insertion loss of −3 dB at an operating frequency of between approximately 19-20 GHz.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector comprising:

a connector housing and a plurality of electrical contacts that are supported by the connector housing, the plurality of electrical contacts defining a plurality of broadside coupled differential signal pairs, wherein the electrical contacts of the differential signal pairs are spaced along a row direction, and the connector housing defining a mating interface configured to mate with a complementary electrical component so as to place the complementary electrical component in electrical communication with the electrical contacts, and a mounting interface configured to be mounted onto a substrate;

a plurality of electrically conductive ground shields disposed between adjacent differential signal pairs along the row direction; and a conductive ground commoning member electrically connected to the electrically conductive ground shields at the mating interface of the connector housing and electrically isolated from the electrical contacts of the differential signal pairs.

2. The electrical connector as recited in claim 1, wherein the differential signal pairs are arranged along first and second rows that are spaced from each other along a column direction that is substantially perpendicular to the row direction and the conductive ground commoning member is disposed between the first and second rows of differential signal pairs, such that the electrical contacts of the first row of differential signal pairs are disposed on one side of the conductive ground commoning member and the electrical contacts of the second row of differential signal pairs are disposed on an opposite side of the conductive ground commoning member.

3. The electrical connector as recited in claim 2, wherein differential signal pairs of the first row are configured to transmit data in a direction from the mounting interface toward the mating interface, and the differential signal pairs of the second row are configured to transmit data in a direction from the mating interface toward the mounting interface.

4. The electrical connector as recited in claim 3, wherein each row is a receptacle configured to receive respective edge cards.

5. The electrical connector as recited in claim 1, further comprising a plurality of first leadframe assemblies spaced along the row direction, each of the first leadframe assemblies including a first leadframe housing that retains respective ones of the electrical contacts, wherein adjacent ones of the first leadframe assemblies are arranged in pairs, such that at least one of the respective electrical contacts of each pair defines a differential signal pair.

6. The electrical connector as recited in claim 5, wherein the first leadframe housings are overmolded onto the respective ones of the electrical contacts.

7. The electrical connector as recited in claim 5, further comprising a plurality of second leadframe assemblies, each of the second leadframe assemblies including the ground shield and a leadframe housing that retains the ground shield, wherein ones of the second leadframe assemblies are disposed between respective pairs of the first leadframe assemblies.

8. The electrical connector as recited in claim 1, wherein the ground shields each define a retention slot, and the ground commoning member is retained in the retentions slot so as to electrically connect the ground shields.

9. The electrical connector as recited in claim 8, wherein the ground shields comprise a plurality of teeth that at least partially define the retention slots and are configured to engage the retained ground commoning member.

10. The electrical connector as recited in claim 5, wherein the first leadframe housings define slots that receive the ground commoning member.

11. The electrical connector as recited in claim 1, wherein the ground commoning member comprises a plate.

12. The electrical connector as recited in claim 11, wherein the plate is elongate along a plane that is substantially parallel to the mounting interface.

13. The electrical connector as recited in claim 1, wherein the electrical contacts and the ground shields define respective mating portions that are configured to electrically connect to a complementary electrical component along a mating direction, and the ground commoning member is substantially aligned with the mating portions along a direction that is substantially perpendicular to the mating direction.

14. The electrical connector as recited in claim 1, further comprising a plurality of leadframe assemblies each including a leadframe housing and one of the electrically conductive ground shields overmolded by the leadframe housing.

15. An electrical connector comprising:

a connector housing;

a plurality of first leadframe assemblies each including a first leadframe housing and a plurality of electrical signal contacts supported by the first leadframe housing, wherein the plurality of first leadframe housings are supported by the connector housing and spaced from each other along a row direction, and the plurality of first leadframe assemblies are arranged in pairs that include a first select leadframe assembly of the plurality of first leadframe assemblies and a second select leadframe assembly of the plurality of first leadframe assemblies, such that one of the electrical signal contacts of the first select leadframe assembly and one of the electrical signal contacts of the second select leadframe assembly defines a differential signal pair;

a plurality of second leadframe assemblies supported by the connector housing and disposed between adjacent pairs of the first leadframe assemblies, wherein each of the second leadframe assemblies includes a second leadframe housing different from the first leadframe housings and an electrically conductive shield supported by the second leadframe housing, and the electrically conductive shield is disposed between the differential signal pairs of the adjacent pairs of the first leadframe assemblies; and a ground commoning member electrically connected to each of the plurality of second leadframe assemblies and electrically isolated from each of the plurality of electrical signal contacts.

16. The electrical connector as recited in claim 15, wherein the electrical signal contacts each differential signal pair are broadside coupled.

17. The electrical connector as recited in claim 15, wherein each of the first and second select leadframe assemblies comprise first and second rows of electrical contacts that each includes a first electrical contact and a second electrical contact spaced from the first electrical contact, wherein each of the first and second rows of electrical contacts are configured to mate with first and second optical transceivers, respectively, and wherein the conductive ground commoning member is disposed in the connector housing such that electrical contacts on one side of the conductive ground commoning member are configured to transmit electrical signals to a first respective transceiver and electrical contacts on an opposite side of the conductive ground commoning member are configured to transmit electrical signals from a second respective transceiver.

18. The electrical connector as recited in claim 17, wherein the first and second electrical contacts of each row of the first select leadframe assembly and the first and second electrical contacts of each row of the second select leadframe assembly of each pair defines respective differential signal pairs.

19. The electrical connector as recited in claim 18, wherein the electrically conductive shield is disposed between and overlaps each of the differential signal pairs of adjacent pairs of first and second select leadframe assemblies.

20. The electrical connector as recited in claim 2, wherein the electrical contacts on the one side of the ground commoning member are configured to transmit electrical signals to a first respective transceiver and the electrical contacts on the opposite side of the conductive ground commoning member are configured to transmit electrical signals from a second respective transceiver.

21. The electrical connector as recited in claim 1, wherein the connector housing defines a front end and an opposed rear end that is spaced from the front end, the mating interface disposed proximate to the front end, and the ground commoning member is encapsulated by the connector housing at the front end of the connector housing.

22. The electrical connector as recited in claim 2, wherein each electrical contact defines a mating portion, each electrically conductive ground shield defines a plurality of mating portions, and the ground commoning member is aligned with respective portions of the mating portions of the plurality of electrical contacts and with respective portions of the mating portions of the plurality of electrically conductive ground shields, respectively, with respect to the column direction.

23. The electrical connector as recited in claim 5, wherein each of the first leadframe housings are electrically insulative.

24. The electrical connector as recited in claim 15, wherein the first and second leadframe housings are electrically insulative.

25. The electrical connector as recited in claim 15, further comprising a mating interface configured to mate with a complementary electrical component so as to place the complementary electrical component in electrical communication with the electrical contacts, and a mounting interface configured to be mounted onto a substrate, wherein the ground commoning member is electrically connected to each of the plurality of second leadframe assemblies at the mating interface.

26. An electrical connector comprising:

a connector housing that defines a mating interface and a mounting interface, the connector housing supporting a plurality of electrical contacts that define a plurality of broadside coupled differential signal pairs, wherein the electrical contacts of the differential signal pairs are spaced along a row direction;

a plurality of electrically conductive ground shields disposed between adjacent differential signal pairs along the row direction;

a conductive ground commoning member in electrical communication with the ground shields and electrically isolated from the electrical contacts of the differential signal pairs;

a plurality of first leadframe assemblies spaced along the row direction, each of the first leadframe assemblies including a first leadframe housing that retains respective ones of the electrical contacts, wherein adjacent ones of the first leadframe assemblies are arranged in pairs, such that at least one of the respective electrical contacts of each pair defines a differential signal pair; and a plurality of second leadframe assemblies, each of the second leadframe assemblies including the ground shield and a leadframe housing that retains the ground shield, wherein one of the second leadframe assemblies are disposed between respective pairs of the first leadframe assemblies.

27. The electrical connector as recited in claim 26, wherein the ground shields each define a retention slot, and the ground commoning member is retained in the retentions slot so as to electrically connect the ground shields.

28. The electrical connector as recited in claim 27, wherein the ground shields comprise a plurality of teeth that at least partially define the retention slots and are configured to engage the retained ground commoning member.

* * * * *